US008704589B2

(12) United States Patent
Kotowski et al.

(10) Patent No.: US 8,704,589 B2
(45) Date of Patent: Apr. 22, 2014

(54) REFERENCE VOLTAGE CIRCUITS

(75) Inventors: Jeff Kotowski, Nevada City, CA (US); Andre Gunther, San Jose, CA (US)

(73) Assignee: Atmel Corporation, San Jose, CA (US)

( * ) Notice: Subject to any disclaimer, the term of this patent is extended or adjusted under 35 U.S.C. 154(b) by 0 days.

(21) Appl. No.: 13/595,770

(22) Filed: Aug. 27, 2012

(65) Prior Publication Data

US 2014/0055166 A1 Feb. 27, 2014

(51) Int. Cl.
*G05F 1/10* (2006.01)

(52) U.S. Cl.
USPC ..... 327/539; 327/540

(58) Field of Classification Search
USPC ..... 327/539, 530, 538, 540, 542, 560, 561, 327/563
See application file for complete search history.

(56) References Cited

U.S. PATENT DOCUMENTS

2007/0013436 A1* 1/2007 Chou ..... 327/539
2010/0188141 A1* 7/2010 Aruga et al. ..... 327/539
2011/0163799 A1* 7/2011 Kuang et al. ..... 327/539
2011/0169561 A1* 7/2011 Chu et al. ..... 327/539

OTHER PUBLICATIONS

Brokaw, "A Simple Three-Terminal IC Bandgap Reference," IEEE Journal of Solid-State Circuits, vol. 9, Issue 6, p. 388-393, Dec. 1974.

* cited by examiner

*Primary Examiner* — Lincoln Donovan
*Assistant Examiner* — Jung H Kim
(74) *Attorney, Agent, or Firm* — Fish & Richardson P.C.

(57) ABSTRACT

A reference voltage circuit corrects for bandgap voltage shifts induced during fabrication. The reference voltage circuit generates a reference voltage using first and second base-emitter pairs. The reference voltage circuit sums the voltage across the first base-emitter pair with a difference voltage. During a first time period, the difference voltage is the voltage across the first base-emitter pair minus the voltage across the second base-emitter pair, and during a second time period, the difference voltage is the voltage across the second base-emitter pair minus the voltage across the first base-emitter pair.

12 Claims, 6 Drawing Sheets

REFERENCE VOLTAGE CIRCUITS

TECHNICAL FIELD

This disclosure relates generally to electronics and more particularly to reference voltage circuits.

BACKGROUND

A reference voltage circuit is a circuit that produces a fixed voltage to a device. The fixed voltage is substantially constant despite variations in temperature. Conventional bandgap reference voltage circuits use a combination of a bipolar (or diode) base-emitter junction voltage (Vbe) and a proportional to absolute temperature (PTAT) voltage. Vbe is roughly 650 mV at room temperature and has a negative temperature coefficient (TC). The PTAT voltage has a positive TC which, when added to the negative TC of the Vbe, creates a low temperature coefficient reference voltage of about 1.24 volts.

When fabricating voltage reference circuits in integrated circuits, pressure from the package on the integrated circuit die can alter the fixed voltage produced by a voltage reference circuit. One way to avoid this problem is to use a ceramic package that can be hermetically sealed and does not induce pressure on the die. Another way to avoid this problem is to use a die coat that displaces pressure normally placed on the die. These methods can increase the production cost.

SUMMARY

A reference voltage circuit corrects for bandgap voltage shifts induced during fabrication. The reference voltage circuit generates a reference voltage using first and second base-emitter pairs. The reference voltage circuit sums the voltage across the first base-emitter pair with a difference voltage multiplied by a factor of K. During a first time period, the difference voltage is the voltage across the first base-emitter pair minus the voltage across the second base-emitter pair, and during a second time period, the difference voltage is the voltage across the second base-emitter pair minus the voltage across the first base-emitter pair.

Particular implementations can provide one or more of the following advantages: 1) the reference voltage circuit can correct for shifts in the bandgap voltages induced during fabrication; 2) the reference voltage circuit can correct for offset due to an operational amplifier; 3) the reference voltage circuit can be fabricated at a reduced cost compared to conventional reference voltage circuits that are insensitive to the fabrication process; and 4) post-fabrication testing of the reference voltage circuit can be reduced or eliminated in some cases, saving time and cost of fabrication.

The details of one or more disclosed implementations are set forth in the accompanying drawings and the description below. Other features, aspects, and advantages will become apparent from the description, the drawings and the claims.

DETAILED DESCRIPTION

Example Reference Voltage Circuit

Figure 1A:
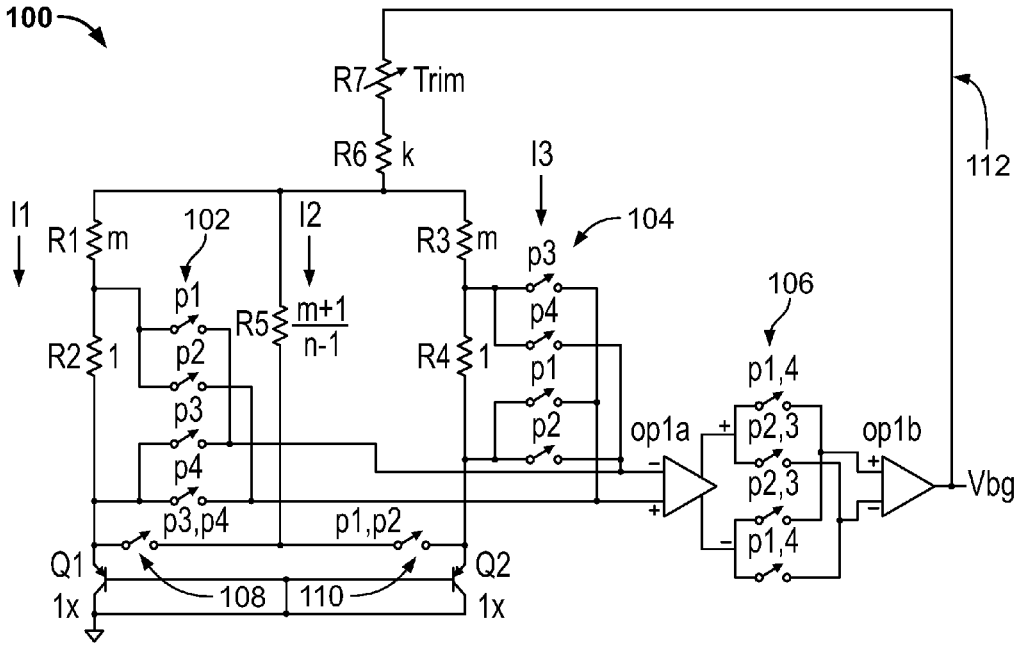
FIG. 1A is a schematic diagram of a reference voltage circuit.

FIG. 1A is a schematic diagram of a reference voltage circuit 100. The reference voltage circuit substantially corrects for errors in the output reference voltage due to package pressure during fabrication.

The reference voltage circuit includes two bipolar junction transistors (BJTs) Q1 and Q2. Transistors Q1 and Q2 each comprise a base-emitter pair, and the transistors each have approximately equal emitter areas.

Transistors Q1 and Q2 are coupled to a network of resistors R1-R7, a network of switches 102, 104, 106, 108, 110, and a feedback loop 112. The feedback loop includes an operational amplifier that includes a first stage op1a and a second stage op1b. The output of stage op1b is the bandgap reference voltage, Vbg. The output voltage is fed back into the network of resistors.

In operation, the operational amplifier serves to drive current into transistors Q1 and Q2. A control circuit provides control signals p1-p4 to the network of switches. In general, the control signals oscillate at a same frequency (e.g., 500 kHz) but at different respective phases and duty cycles.

The reference voltage Vbg is the sum of 1) the voltage across one of transistors Q1 and Q2 (Vbe), and 2) a difference between the voltages across both transistors Q1 and Q2 (ΔVbe). For example, Vbe can be the voltage across Q1 when control signals p3 or p4 are high and the voltage across Q2 when control signals p1 and p2 are high. A network of resistors amplifies ΔVbe. Vbe has a negative temperature coefficient and ΔVbe has a positive temperature coefficient. By adding Vbe to ΔVbe in a proper ratio, Vbg is substantially constant despite temperature changes.

The control circuit is configured to generate the switching signals so that, during a first time period, ΔVbe is equal to the voltage across Q1 minus the voltage across Q2, and during a second time period, ΔVbe is equal to the voltage across Q2 minus the voltage across Q1. By continuously toggling the switches, the resulting average ΔVbe over time cancels out any voltage shift from stress on the package.

Pressure from the package on the integrated circuit die can induce a shift in Vbe. In addition to the Vbe shift, the pressure also causes a ΔVbe shift. The effect on Vbg from the Vbe shift is 1:1, so that a 1 mV shift in Vbe also shifts Vbg by 1 mV. However, ΔVbe is typically amplified, e.g., by a factor of 5, 10, or 20, so that a 1 mV shift in ΔVbe shifts Vbg by 5, 10, or 20 mV. Thus, most of the resulting voltage shift in Vbg is due to the shift in ΔVbe.

In the example reference voltage circuit of FIG. 1, ΔVbe is generated so that the average output at Vbg cancels the ΔVbe package shift. With the ΔVbe shift cancelled, only the relatively small Vbe shift affects Vbg. The four phase implementation illustrated in FIG. 1 also cancels the offset of the operational amplifier.

When signals p1 and p2 are high, resistor R5 is connected to transistor Q2, thus increasing its Vbe. The ΔVbe is applied across R2. When signal p1 is high, the differential input to op1a is negative and the differential input to op1b is the positive output of op1a. When signal p2 is high, the polarities of both amplifiers op1a and op1b is reversed, so the feedback loop maintains a negative feedback through both phases. When signal p1 is high, the output Vbg includes the ΔVbe of Q2−Q1 and the offset of the opamp (op1a and op1b). When signal p2 is high, the output Vbg includes the negative offset of the opamp and the ΔVbe from Q2−Q1. Similarly the opamp offset is inverted between when signal p3 is high and when signal p4 is high, and the ΔVbe is from Q1−Q2. The reference voltage circuit output multiplies the ΔVbe and opamp offset by a factor K. In this example, K is approximately R3/R4.

Figure 1B:
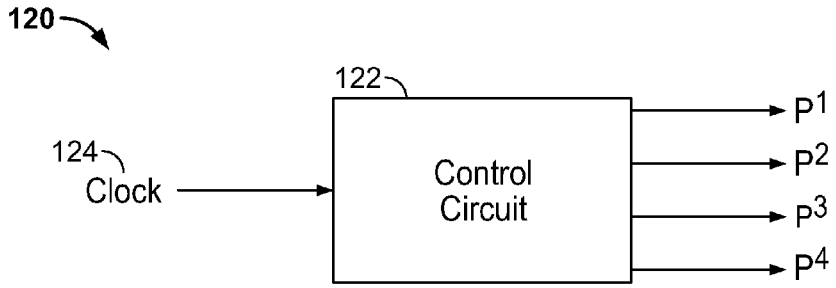
FIG. 1B is a block diagram of a system including an example control circuit configured to provide switching signals to the reference voltage circuit of FIG. 1A.

FIG. 1B is a block diagram of a system 120 including an example control circuit 122 configured to provide switching signals to the reference voltage circuit 100 of FIG. 1A. The control circuit receives a clock signal 124 and generates switching signals p1-p4.

Figure 1C:
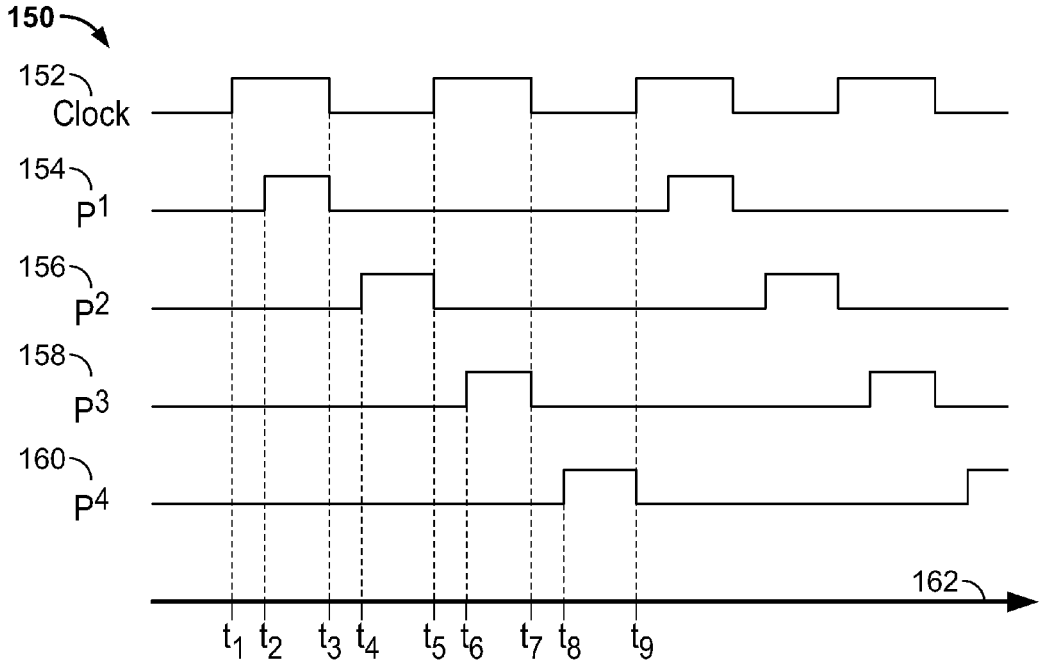
FIG. 1C is a timing diagram for the example control circuit of FIG. 1B.

FIG. 1C is a timing diagram for the example control circuit 122 of FIG. 1B. The timing diagram illustrates a clock signal 152, a first control signal p1 154, a second control signal p2 156, a third control signal p3 158, and a fourth control signal p4 160 along a timeline 162.

At time t1, the clock signal rises. At time t2, signal p1 rises. The difference in time between t2 and t1 is generally some time shorter than the period of the clock signal or half of the period of the clock signal. At time t3, the clock signal falls and signal p1 falls. At time t4, signal p2 rises. The difference between time t4 and t3 can be the same as the difference between times t2 and t1.

At time t5, the clock signal rises and signal p2 falls. At time t6, signal p3 rises. The difference between time t6 and t5 can be the same as the difference between times t2 and t1. At time t7, the clock signal falls and signal p3 falls. At time t8, signal p4 rises. The difference between time t8 and t7 can be the same as the difference between times t2 and t1. At time t9, the clock signal rises and signal p4 falls, and the control circuit begins to repeat the sequence between t1-t9.

Example Reference Voltage Circuit During One Phase

Figure 2:
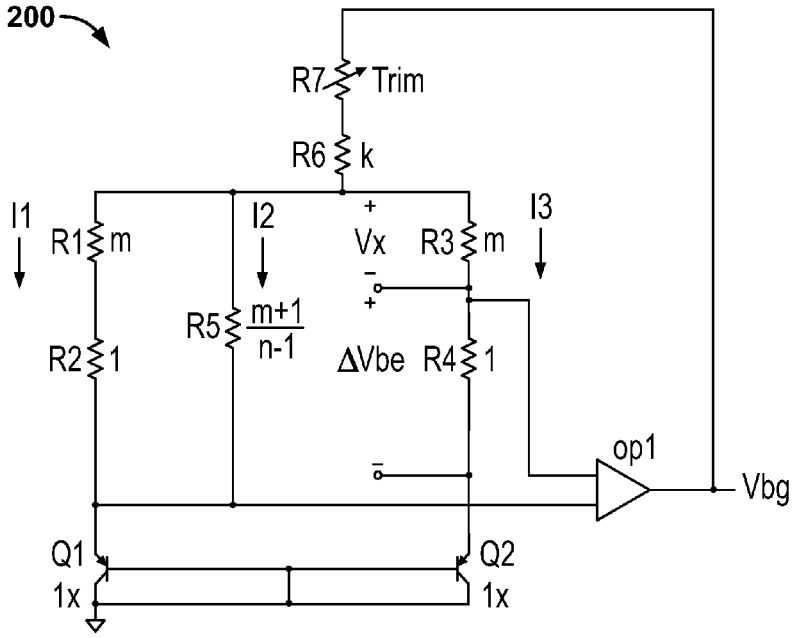
FIG. 2 is a schematic diagram of the example reference voltage circuit of FIG. 1A when one of the control signals is high.

FIG. 2 is a schematic diagram of the example reference voltage circuit of FIG. 1 when one of the control signals is high. The network of switches is not illustrated; instead, connections are shown as they would be during the time period that the control signal is high. FIG. 2 is shown for purposes of circuit analysis. The circuit has the same general topology when each of the control signals is high.

In this example, the resistance of resistor R5 is as (m+1)/(n−1), but the resistor can have other values, e.g., to achieve different gains in the system. The currents labeled in the system can be expressed as follows:

$$I_1 = \frac{1}{m+1}Vx$$

$$I_2 = \frac{n-1}{m+1}Vx$$

$$I_3 = \frac{1}{m}Vx$$

$$I_{Q1} = I_1 + I_2 = \frac{n}{m+1}Vx$$

The difference in the Vbe of Q1 and Q2 depends on the ratio of currents through the collectors. For purposes of illustration, emitter current replaces the collector current in this analysis, which is a valid simplification for large β. Assuming the transistors Q1 and Q2 are operating in the region of relatively constant β, ΔVbe can be expressed as follows:

$$\Delta Vbe = Vt \cdot \ln\left(\frac{I_{Q1}}{I_3}\right) = Vt \cdot \ln\left(\frac{\frac{n}{m+1}}{\frac{1}{m}}\right) = Vt \cdot \ln\left(\frac{m}{m+1}n\right)$$

For purposes of illustration, the value of the adjustable trim resistor R7 can be assumed to be zero. Then Vbg can be expressed as follows:

$$Vbg = Vbe + I_3 \cdot (m+1) + k \cdot (I_1 + I_2 + I_3),$$

Where Vbe is the voltage from the emitter to the base of transistor Q2. The currents can then be expressed in terms of ΔVbe because Vx=m*ΔVbe, as follows:

$$I_1 = \frac{1}{m+1}m \cdot \Delta Vbe$$

$$I_2 = \frac{n-1}{m+1}m \cdot \Delta Vbe$$

$$I_3 = \Delta Vbe$$

Hence, Vbg can be expressed as:

$$Vbg = Vbe + (m+1)\Delta Vbe + k \cdot \left(\frac{1}{m+1}m + \frac{n-1}{m+1}m + 1\right)\Delta Vbe$$

$$Vbg = Vbe + (m+1)\Delta Vbe + k \cdot \left(n\frac{m}{m+1} + 1\right)\Delta Vbe$$

This expression of Vbg can be written as:

$$Vbg = Vbe + \left(n\frac{m}{m+1}k + k + m + 1\right)\Delta Vbe$$

As a result, n, m, and k can be selected to provide varying levels of gain for ΔVbe. The trim range is set by resistor R7. Once the trim range is determined, the resistance of resistor R6, k, can be reduced by half the trim range. This sets the nominal trim range center value to the nominal bandgap voltage and allows the trim to go positive or negative as required. Hence the trim range need not be included in nominal calculations for purposes of illustration.

Example Switch Insensitive Reference Voltage Circuit

Figure 3:
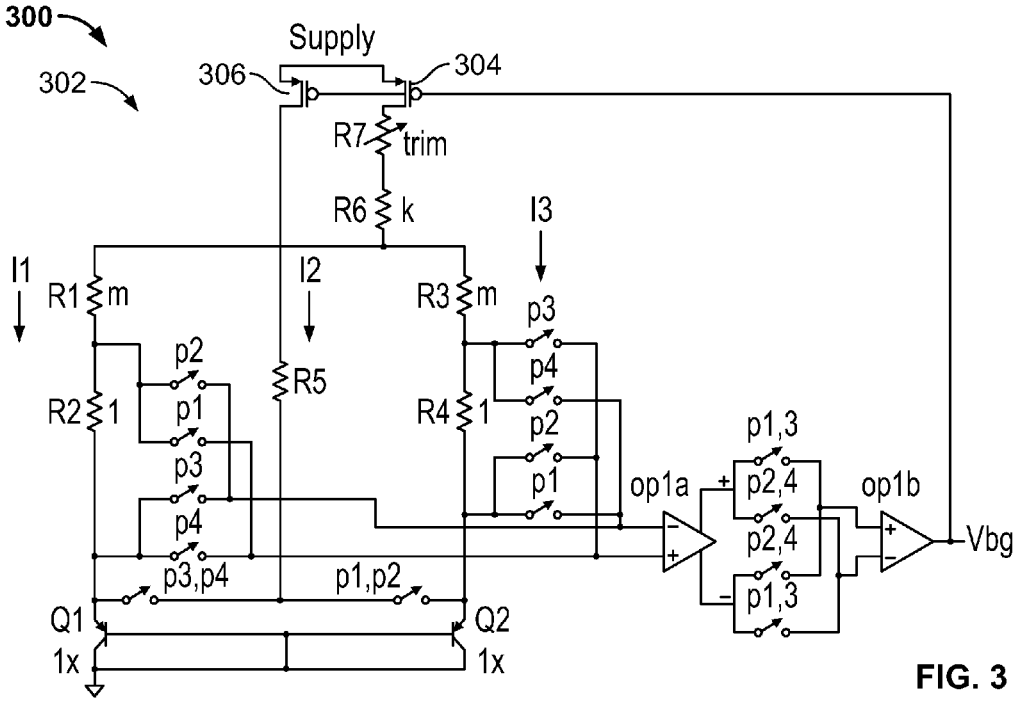
FIG. 3 is schematic diagram of an example reference voltage circuit that reduces the effects of the resistances of the switches in the network of switches.

FIG. 3 is schematic diagram of an example reference voltage circuit that reduces the effects of the resistances of the switches in the network of switches. To reduce the effect of the switches, the switches can be made large to reduce the resistance. This will reduce the effect of the switches as well as any variation in the switch resistance over process and temperature. The resistance of resistor R5 can be varied to account for the nominal resistances of the switches. Switches can be added to other current paths to maintain a certain gain ratio.

Alternatively, the circuit can include a current source 302 to set the current flowing through transistors Q1 and Q2, as shown in FIG. 3. The current source includes two transistors 304 and 306 and a supply voltage. The feedback loop couples to the gates of transistors 304 and 306. In this case, the current in transistors Q1 and Q2 is independent of the resistance of the switches. Resistor R5 sets the voltage on the drain of transistor 306 approximately equal to the voltage on the drain of transistor 304. The output Vbg can be expressed as follows:

$$Vbg=Vbe+I_3\cdot(m+1)+k\cdot(I_1+I_3)$$

$$Vbg = Vbe + \Delta Vbe\cdot(m+1) + k\cdot\left(\frac{1}{m+1}m\cdot\Delta Vbe + \Delta Vbe\right)$$

$$Vbg = Vbe + \left(\frac{2m+1}{m+1}k + m + 1\right)\Delta Vbe$$

Example Supply Referenced Circuit

Figure 4:
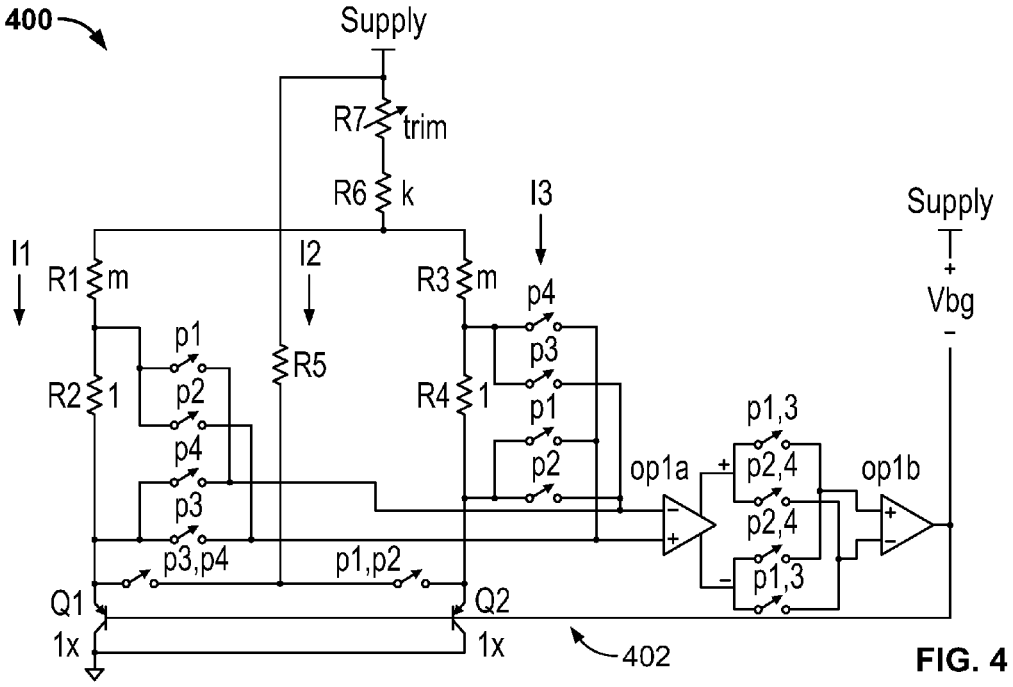
FIG. 4 is a schematic diagram of an example reference voltage circuit that is supply referenced.

FIG. 4 is a schematic diagram of an example reference voltage circuit 400 that is supply referenced. For a ground referenced supply the common mode input of the operational amplifier requires one of the base-emitter voltages to be above ground. For low voltage supplies it may not be possible to operate the opamp inputs at a Vbe. By referencing the output to the supply, the circuit can increase the voltage at the operational amplifier to a more practical common mode range.

As shown in FIG. 4, a feedback loop 402 is coupled between the output of the operational amplifier and the bases of transistors Q1 and Q2. The output Vbg is produced at the output of the operational amplifier and between a voltage supply. The voltage supply is also coupled to the network of resistors.

Example Two Phase Reference Voltage Circuit

Figure 5A:
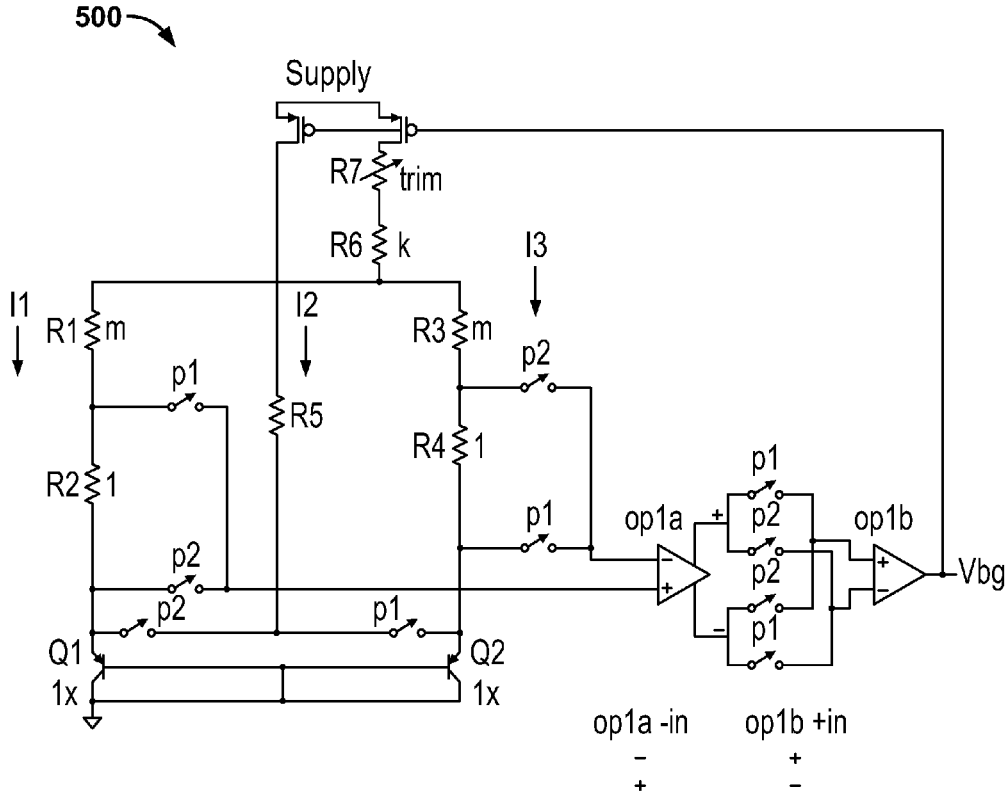
FIG. 5A is a schematic diagram of an example two phase reference voltage circuit.

FIG. 5A is a schematic diagram of an example two phase reference voltage circuit 500. The example circuit, as shown, is ground referenced, but the circuit can alternatively be supply referenced, e.g., as illustrated in FIG. 4. The example, as shown, includes a current source to drive transistors Q1 and Q2, but this feature is also optional, as described above.

A control circuit or other circuit generates two control signals, p1 and p2. In general, the control signals oscillate at a same frequency but at different respective phases. The offset of the two phase circuit goes through the gain (m+1) in each phase. The gain is set by (R3+R4)/R4 in one phase, and (R1+R2)/R2 in the other. Because the resistors can have some matching error, the offset cancellation can depend on the matching of the resistors. In some cases the matching can be made better than 1%, cancelling 99% of the offset. For an operational amplifier with 5 mV of offset, the net result can be 50 uV.

Figure 5B:
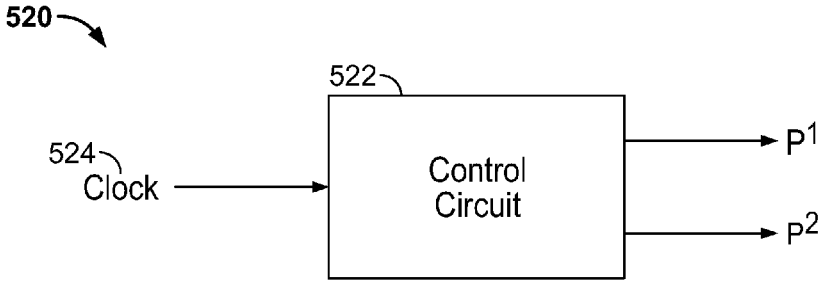
FIG. 5B is a block diagram of a system including an example control circuit configured to provide switching signals to the reference voltage circuit of FIG. 5A.

FIG. 5B is a block diagram of a system 520 including an example control circuit 522 configured to provide switching signals to the reference voltage circuit 500 of FIG. 5A. The control circuit receives a clock signal 524 and generates switching signals p1-p2.

Figure 5C:
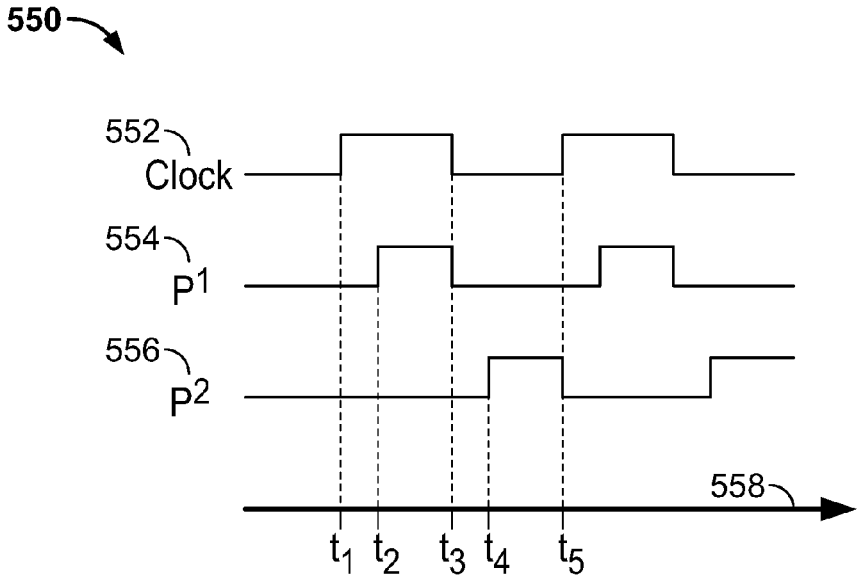
FIG. 5C is a timing diagram for the example control circuit of FIG. 5B.

FIG. 5C is a timing diagram for the example control circuit 522 of FIG. 5B. The timing diagram illustrates a clock signal 552, a first control signal p1 554, and a second control signal p2 556 along a timeline 558.

At time t1, the clock signal rises. At time t2, signal p1 rises. The difference in time between t2 and t1 is generally some time shorter than the period of the clock signal or half of the period of the clock signal. At time t3, the clock signal falls and signal p1 falls. At time t4, signal p2 rises. The difference between time t4 and t3 can be the same as the difference between times t2 and t1. At time t5, the clock signal rises and signal p2 falls, and the control circuit begins to repeat the sequence between t1-t5.

Example Voltage Reference Generation Flowchart

Figure 6:
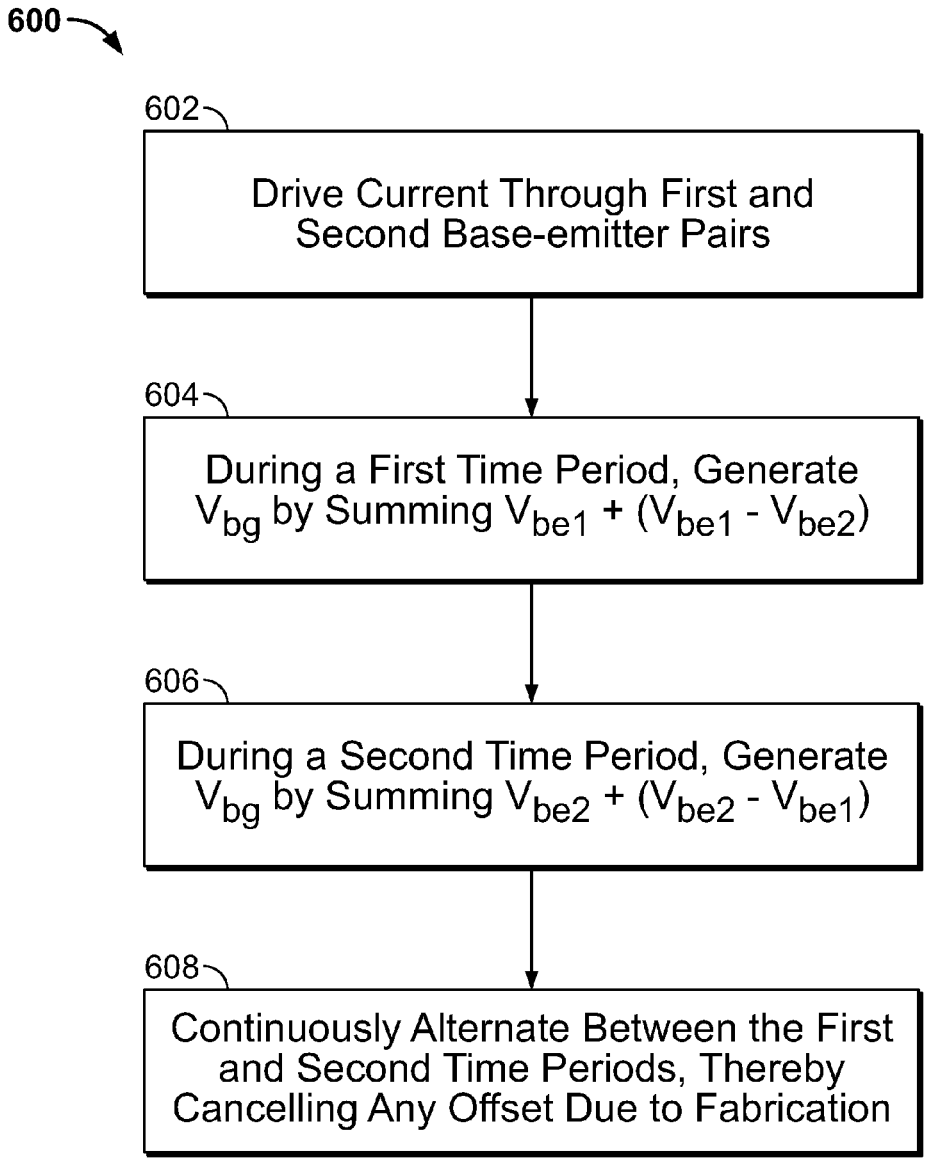
FIG. 6 is a flow diagram of an example process performed by a reference voltage circuit for generating a reference voltage.

FIG. 6 is a flow diagram of an example process 500 performed by a reference voltage circuit for generating a reference voltage.

The reference voltage circuit drives current through first and second base-emitter pairs (602). During a first time period, the reference voltage circuit generates an output Vbg by summing 1) the voltage across the first base-emitter pair and 2) the voltage across the first base-emitter pair minus the voltage across the second base-emitter pair, multiplied by a factor K (604). During a second time period, the reference voltage circuit generates the output Vbg by summing 1) the voltage across the second base-emitter pair and 2) the voltage across the second base-emitter pair minus the voltage across the first base-emitter pair, multiplied by K (606). The second time period is substantially the same length of time as the first time period. By continuously alternating between the first time period and the second time period, the reference voltage circuit can cancel offset voltages induced in the base-emitter pairs during fabrication.

The reference voltage circuit can additionally, or alternatively, operate as follows. During the first time period, the reference voltage circuit generates the output Vbg by summing 1) the voltage across the first base-emitter pair and 2) the voltage across the second base-emitter pair minus the voltage across the first base-emitter pair, multiplied by a factor K. During the second time period, the reference voltage circuit generates the output Vbg by summing 1) the voltage across the second base-emitter pair and 2) the voltage across the first base-emitter pair minus the voltage across the second base-emitter pair, multiplied by K.

While this document contains many specific implementation details, these should not be construed as limitations on the scope what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub combination. Moreover, although features may be described above as acting in certain combinations and even initially claimed as such, one or more features from a claimed combination can, in some cases, be excised from the combination, and the claimed combination may be directed to a sub combination or variation of a sub combination.

What is claimed is:

1. A reference voltage circuit comprising:

first and second base-emitter pairs;

a feedback loop configured to drive a current through each of the first and second base-emitter pairs;

a plurality of switches coupled between the feedback loop and the first and second base-emitter pairs, including first and second switches controlled by a first control signal and third and fourth switches controlled by a second control signal complementary to the first control signal; and a network of resistors coupled between the feedback loop and the plurality of switches, including first and second resistors for setting a gain when the first control signal is active and third and fourth resistors for setting the gain when the second control signal is active, wherein the first and second resistors have resistances approximately equal to the resistances of the third and fourth resistors, respectively;

wherein the voltage reference circuit is configured to generate a reference voltage by summing the voltage across the first base-emitter pair with a difference voltage multiplied by a factor of K, and wherein the voltage reference circuit is configured to toggle the switches so that during a first time period defined by the first control signal, the difference voltage is the voltage across the first base-emitter pair minus the voltage across the second base-emitter pair, and during a second time period defined by the second control signal, the difference voltage is the voltage across the second base-emitter pair minus the voltage across the first base-emitter pair.

2. The reference voltage circuit of claim 1, wherein the feedback loop includes an operational amplifier, and wherein the first and second base-emitter pairs are coupled via the plurality of switches to two inputs of the operational amplifier, and wherein an output of the operational amplifier is coupled to the plurality of switches.

3. The reference voltage circuit of claim 2, wherein the operational amplifier comprises first and second stages, and wherein a subset of the plurality of switches is coupled between an output of the first stage and an input of the second stage.

4. The reference voltage circuit of claim 1, the network of resistors comprising at least one adjustable trim resistor coupled between a supply voltage and the network of resistors, wherein the second resistor is coupled between the first base-emitter pair and the first switch, the first resistor is coupled between the first switch and the third resistor, and the fourth resistor is coupled between the third resistor and the second base-emitter pair and the second switch.

5. The reference voltage circuit of claim 1, wherein the feedback loop includes a constant current source to drive the current through either of the first and second base-emitter pairs.

6. The reference voltage circuit of claim 5, wherein the constant current source comprises first and second transistors, each of the first and second transistors comprising: a respective gate coupled to the feedback loop, a respective source coupled to a supply voltage, and a respective drain coupled to the plurality of switches.

7. The reference voltage circuit of claim 1, wherein the reference voltage circuit is ground referenced.

8. The reference voltage circuit of claim 1, wherein the reference voltage circuit is supply referenced.

9. The reference voltage circuit of claim 1, further comprising a control circuit to control the plurality of switches, and wherein the control circuit generates the first and second control signals.

10. The reference voltage circuit of claim 1, further comprising a control circuit to control the plurality of switches, and wherein the control circuit generates four control signals, each control signal to control a respective subset of the plurality of switches.

11. The reference voltage circuit of claim 1, wherein the first and second base-emitter pairs are diodes.

12. The reference voltage circuit of claim 1, wherein the first and second base-emitter pairs are transistors.

* * * * *